US005595522A

United States Patent [19]

Simpson et al.

[11] Patent Number: 5,595,522

[45] Date of Patent: Jan. 21, 1997

[54] SEMICONDUCTOR WAFER EDGE POLISHING SYSTEM AND METHOD

[75] Inventors: Vikki S. Simpson; Tom G. Gullett, both of Sherman; Jerry B. Medders, Van Alstyne; Arthur R. Clark, Sherman; Bobby R. Robbins, Denison; Danny R. Newton, Sherman; Lawrence D. Dyer, Richardson; Douglas W. Bilderback, Denison; Clyde A. King, Bells, all of Tex.

[73] Assignee: Texas Instruments Incorporated, Dallas, Tex.

[21] Appl. No.: 178,186

[22] Filed: Jan. 4, 1994

[51] Int. Cl.[6] ..... B24B 49/00

[52] U.S. Cl. ..... 451/5; 451/8; 451/43; 156/654.1; 414/222

[58] Field of Search ..... 451/5, 7, 8, 9, 451/10, 11, 43, 460; 156/654, 345, 662; 414/222, 589

[56] References Cited

U.S. PATENT DOCUMENTS

| | | | |
|---|---|---|---|
| 4,588,473 | 5/1986 | Hisatomi et al. | 156/645 |
| 4,718,202 | 1/1988 | Worsham | 451/28 |
| 4,793,102 | 12/1988 | Dlouhy | 451/28 |
| 4,846,623 | 7/1989 | Otani et al. | 414/225 |
| 4,864,779 | 9/1989 | Ozaki | 451/28 |
| 4,879,258 | 11/1989 | Fisher | 437/225 |
| 4,897,369 | 1/1990 | Berreta et al. | 437/225 |
| 4,910,155 | 3/1990 | Cote et al. | 437/8 |
| 5,087,307 | 2/1992 | Nomura et al. | 451/44 |
| 5,128,281 | 7/1992 | Dyer et al. | 437/225 |
| 5,240,557 | 8/1993 | Dyer et al. | 437/225 |

FOREIGN PATENT DOCUMENTS

| | | | |
|---|---|---|---|
| 0226772 | 7/1987 | European Pat. Off. . | |
| 308134 | 3/1989 | European Pat. Off. | 451/44 |
| 0354586 | 2/1990 | European Pat. Off. . | |
| 2139165 | 5/1990 | Japan | 451/44 |
| 6077188 | 4/1994 | Japan . | |

OTHER PUBLICATIONS

Daitron, Inc., Engineering and Electronic Systems, "Wafer Edge Polisher Model WEP–400 Specifications" Apr. 1993.

FAM Speedfam Corporation, Electronics Equipment Group, A Subsidiary of FAMTEC International, Inc.

*Primary Examiner*—Maurina T. Rachuba

*Attorney, Agent, or Firm*—W. Daniel Swayze, Jr.; Richard L. Donaldson; W. James Brady, III

[57] ABSTRACT

An edge polishing system (20, 320) and method for edge polishing semiconductor wafers is disclosed. The system (20, 320) includes a loader (22, 326), a polisher (24, 328), an unloader (26, 330), and a controller (28, 335). The method includes the steps of loading wafers (28), and spacers (30) into a loader (22) to form a stack (36), moving the stack (36) into a polisher (24) and causing polisher (24) to polish the stack (36), then moving the stack (36) to an unloader (26), which semiautomatically removes the wafers (28) and spacers (30). The system (20) may include a controller (28) for entering the appropriate commands.

19 Claims, 11 Drawing Sheets

SEMICONDUCTOR WAFER EDGE POLISHING SYSTEM AND METHOD

TECHNICAL FIELD OF THE INVENTION

This invention relates to semiconductor wafer edge polishing systems and methods, and more particularly relates to a system for edge pre-polishing and mirror edge polishing of semiconductor wafers.

BACKGROUND OF THE INVENTION

During the manufacture of semiconductor wafers, the edge of the wafer is frequently ground to a rounded or beveled profile by means of an abrasive wheel. The rounded edge reduces chipping during later process steps. The grinding wheel usually contains a diamond abrasive ranging in particle size from 30 to 40 micrometers, and leaves a surface that has visible ridges and valleys as seen under a low power microscope.

A smoother edge surface may he required for manufacturing some integrated circuits than may he provided on edge-ground wafers. Smoother edges are desirable because wafers with rough edges may chip more easily. Additionally edge-ground wafers may contain deeper microcracks than edge-polished wafers, and edge-ground wafers may contain depressions that may be a source of particles in processes that use phosphorus glasses. Edge-ground wafers may cause further resist to form "beaded" edges, i.e., photo resist may not spin correctly to make a uniform layer at the edge of the wafer, but may make an irregular thickened bead around the wafer edge. If this beaded edge is formed, it may cause problems such as particle formation.

Present polishing processes include mechanically abrading wafers with a finer abrasive, dipping the wafer in an acid polishing mixture, treating wafer edges with an acid polishing mixture or by dripping or spraying etchant on to the edge. Mechanical abrasion may have the disadvantage that it does not produce a mirror finish. Dipping the entire wafer in acid may lead to the rounding of the planar surfaces of the wafer unless extreme care is exercised in the process. Acid etching of the edge may have the disadvantage of requiring considerable removal of material to etch a smooth surface, which may cause a problem with maintaining an optimum profile for the wafer.

Wafers are frequently processed as single wafers. Individual processing of single wafers is time-consuming and costly. Some edge polishers carry wafers between threaded shafts, but these wafers have to be individually loaded and unloaded.

SUMMARY OF THE INVENTION

One aspect of the present invention includes a method for automatically or substantially automatically polishing the edges of a batch or stack of semiconductor wafers. The wafers are formed into a stack with spacers between them by a loader, the stack is then moved into a polisher where the edges may be mirror polished with a polishing system, and unloaded by an unloader that removes the spacers and the wafers.

Another aspect of the present invention includes a system for polishing the edges of a batch or stack of semiconductor wafers with a loader for forming a stack of wafers and spacers, a polisher for polishing the edges of the wafers of the stack, and an unloader for separating the wafers and spaces from the stack.

A technical advantage of the present invention is that the system and method allow for edge processing of semiconductor wafers in batches rather than singly, and thus may greatly increase the efficiency and throughput for the polishing process. Another technical advantage of the present invention is that by providing a system and method for automatically or substantially automatically loading, polishing and unloading the wafers, the process is safe, more reliable, and has more reproducible results in a production environment. Yet, another technical advantage of the present invention is that it allows for the polishing of the entire edge of the wafer at one time.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF THE INVENTION

The preferred embodiment of the present invention and its advantages are best understood by referring to FIGS. 1–20 of the drawings, like numerals being used for like and corresponding parts of the various drawings.

Figure 1:
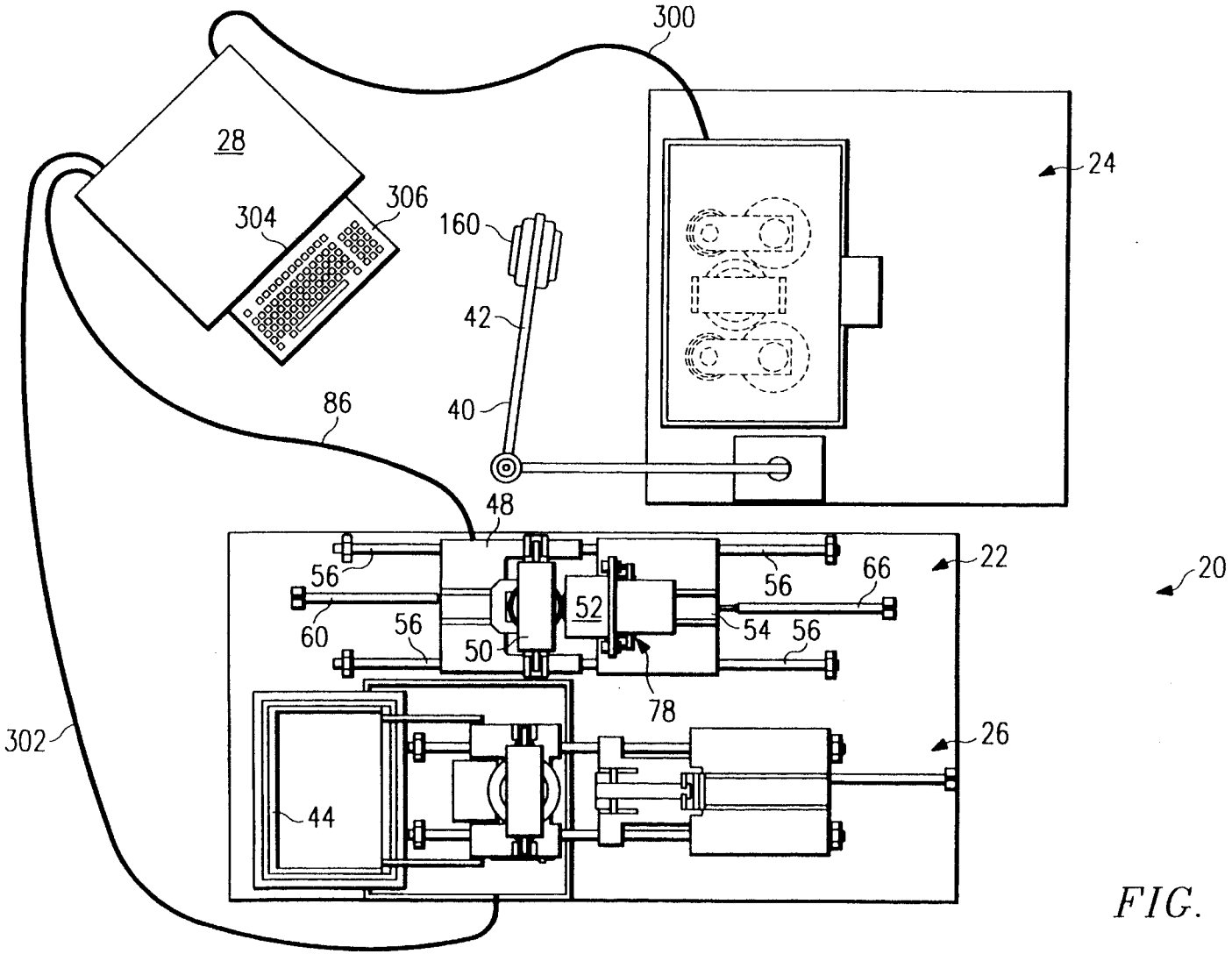
FIG. 1 is a schematic plan view of a polishing system according to an aspect of the present invention.
Figure 13:
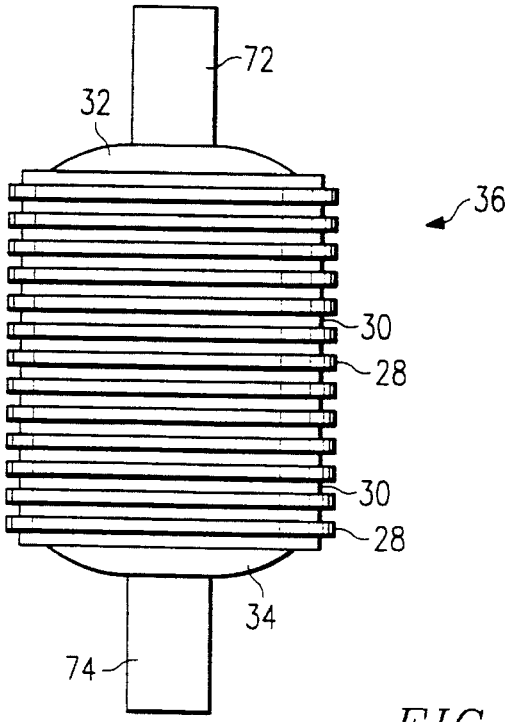
FIG. 13 is a schematic elevational view of a completed stack.

Referring to FIG. 1, a semiconductor wafer edge polishing system 20 according to one aspect of the present invention is shown. System 20 has a loader 22, polisher 24, unloader 26, and controller 28. Loader 22 places semiconductor wafers 28 and spacers 30 in an alternating fashion and compresses the combination between a first clamping plate 32 and a second clamping plate 34 to form a stack 36 as is shown in FIG. 13. After forming stack 36, a transfer unit 40 such as swing hoist 42 may be used to move stack 36 to polisher 24. Polisher 24 may incorporate a pre-polish roller and a polish roller in a chemo-mechanical process as described in U.S. Pat. No. 5,128,281 to Dyer, et al., which is incorporated for all purposes. After polishing wafers 28 in polisher 24, transfer unit 40 may be used to move stack 36 to unloader 26. Unloader 26 may accomplish essentially the opposite of loader 22 by removing clamping plates 32 and 34 and separating wafers 28 and spacers 30. Additionally, unloader 26 may submerge wafers 28 into a neutralizing tank 44 to neutralize any slurry remaining on wafers 28 from the polishing process in polisher 24. Wafers 28 may then be removed from system 20 for further processing. Meanwhile additional wafers 28 may be placed in polishing system 20 to sequentially edge polish stacks 36.

To facilitate the edge processing of wafers 28 in semiconductor wafer edge polishing system 20, it may be desirable to treat wafers 28 before loading wafers 28 into stack 36 in loader 22. For example, because polisher 24 will polish the entire edge of each wafer 28 at one time, it may be desirable to provide an oxide or nitride layer such as deposited by a CVD or a plasma reactor on the back surface of each wafer 28. The oxide or nitride layer will protect the back side of wafer 28 during the polishing process and thereby help to alleviate particle adherence, backside etching during the mirror edge polishing, staining of the back surface, or the need for a backing film such as a poromeric backing film and template polishing. The oxide or nitride layer may be removed after polishing by the cleanup process which may include a hydrofluoric acid treatment. After preparing wafers 28 for polishing as desired, wafers 28 are placed in a wafer cassette or boat 46.

Figure 2:
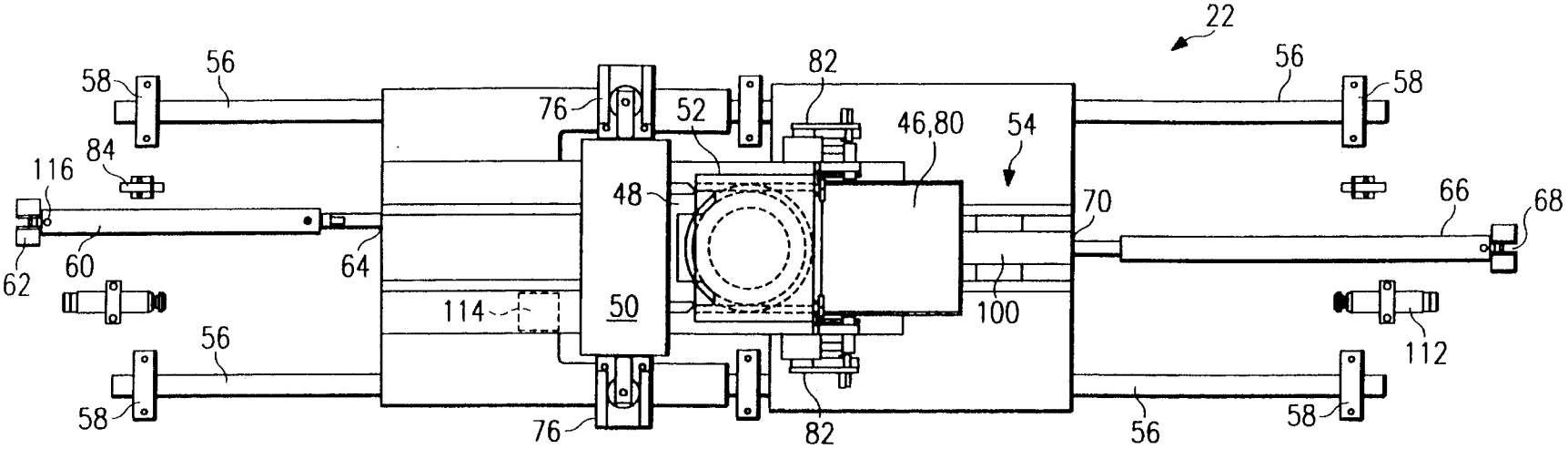
FIG. 2 is a plan view of a loader according to one aspect of the present invention.
Figure 3:
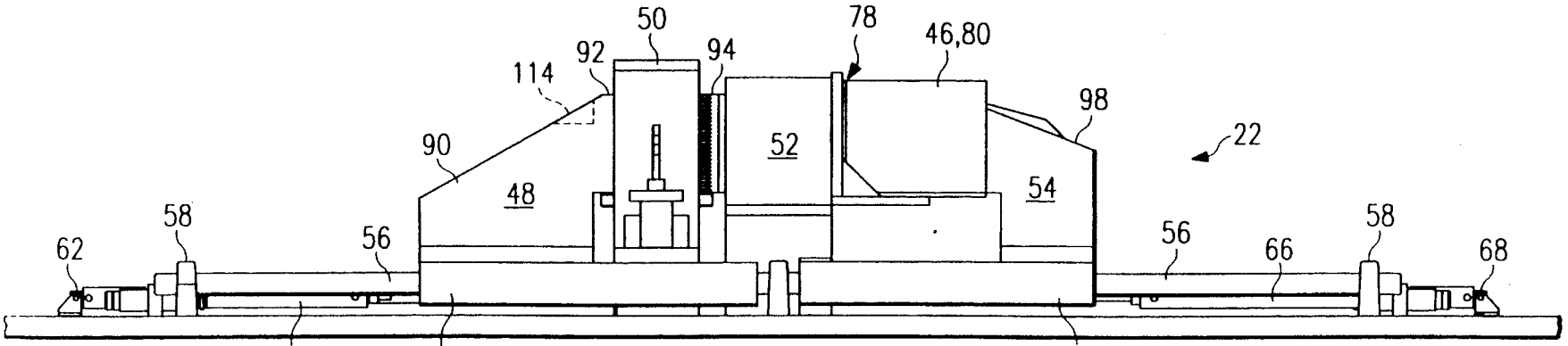
FIG. 3 is an elevational view of the loader of FIG. 2.

Referring now to FIGS. 2 and 3, loader 22 has a moveable alignment tower 48, a clamping station 50, an integrator or integrator box 52, and a pusher 54. Alignment tower 48 and pusher 54 are moveable on guiderails 56, which have anchors 58 for securing rails 56 in place, e.g., to a table top. Alignment tower 48 is moved by air cylinder or actuator 60, which is secured at a first end 62 relative to anchors 58. Second end 64 of actuator 60 is attached to or linked to alignment tower 48. Alignment tower 48 is free to slide relative to guiderails 56 such than when air cylinder 60 is caused to expand the resultant force tends to urge alignment tower 48 away from anchored end 62 of cylinder 60.

Pusher 54 is movably or slidably mounted on guiderails 56. Air cylinder or actuator 66 is anchored relative to anchors 58 about a first end 68 of cylinder 66. A second end 70 of cylinder 66 is secured or linked to pusher 54 such that when air cylinder 66 is caused to expand a force is generated urging pusher 54 away from first end 68 of cylinder 66.

Clamping station 50 contains first clamping plate 32 connected to first mounting shaft 72 and second clamping plate 34 connected to second mounting shaft 74 (FIG. 13). Additionally, clamping station 50 has swing clamps 76 for securing clamping plates 32 and 34. Clamping station 50 may be activated by an operator or by controller 28 at the appropriate time to cause clamping plates 32 and 34 to move towards each other an thereby clamp intermediate spacers 30 and wafers 28 to form stack 36. Loader 22 has a cassette staging area 78 (FIG. 3). Cassette staging area 78 allows for the placement of wafer cassette 46 or a spacer cassette 80 into loader 22. Spacer cassette 80 or wafer cassette 46 may be held against one side of integrator 52 at the appropriate time by swing clamps 82.

Loader 22 has optical sensors, proximity sensors, which may be inductive sensors or contact sensors such as sensor 84, throughout loader 22. The information from the sensors is transmitted by cable link 86 to controller 28. In this manner, controller 28 may sense the position of the various moving components for purposes of monitoring and controlling loader 22.

Alignment tower 48 has a base portion 88, which is mounted on guiderails 56. Alignment tower 48 has an intermediate section 90 between base 88 and an alignment portion 92. Alignment portion 92 of alignment tower 48 is formed to be able to extend through clamping station 50 and up to a side of integrator 52. Alignment portion 92 contains a plurality of shelves 94 to assist with aligning wafers 28 and spacers 30 before and during clamping by clamping station 50.

Integrator 52 may be formed substantially as a box with four surfaces; the inside portion of the vertical surfaces contains shelves or ramps that hold wafers 28 when inserted. The leading edges of the shelves may be chamfered to help guide wafers 28 into integrator box 52. The shelves of integrator 52 may be angled such that the wafers are brought closer together than wafers 28 might otherwise have been in wafer cassette 46. Wafers 28 are suspended by the shelves of integrator 52 at the time when spacers 30 are inserted between wafers 28 such that wafers 28 act as shelves or platforms for holding spacers 30.

Figure 4:
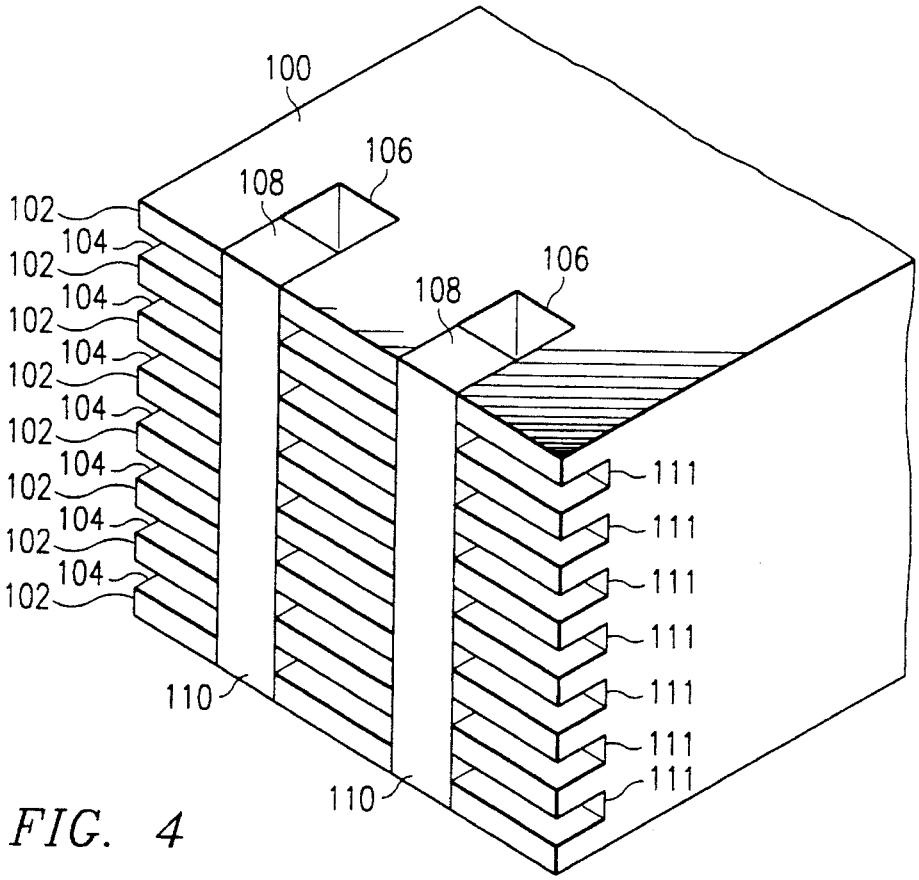
FIG. 4 is a schematic representation of the pusher plate of the loader shown in FIGS. 2–3.

Pusher 54 has a base 96 which is slidably or movably mounted on guiderails 56. Pusher 54 has an intermediate section 98 which is intermediate between base portion 96 and loading plate or block 100. Loading plate 100 is designed to move within wafer cassette 46 or spacer cassette 80 and push the contents of the cassette into integrator 52. Additionally, loading plate 100 is designed to assist with the alignment of wafers 28 and spacers 30 and to push them from integrator 52 to clamping station 50 where wafers 28 and spacers 30 may be clamped to form a stack 36. FIG. 4 is a schematic representation of one embodiment of loading or pusher plate 100.

As shown in FIG. 4, loading or pusher plate 100 has loading fingers 102, which have concomitant shelves 104. A mid-section of fingers 102 and shelves 104 have slots 106 which contain moveable bars 108, which are moveable within slot 106. Bars 108 are moveable within slot 106 between at least two positions: a first position where front face 110 of bars 108 is flush with fingers 102, and a second position where front face 110 of bars 108 is flush with back wall 111 of shelves 104. Moveable bars 108 allow loading plate 100 to push items with either a combination of front face 110 of bars 108 and fingers 102 or with back wall 111 of shelves 104 and fingers 102. The use of these different pushing surfaces will be explained below.

In operation of loader 22, filled wafer cassette 46 with pre-aligned flats (and pre-treated if desired) is manually placed in cassette staging area 78. A sensor, such as a fiber-optic sensor, tells controller 28 that cassette 46 is in position. The filled wafer cassette 46 may be prewarmed to the polishing temperature of polisher 24 to save cycle time when a specific temperature or temperature range is desired in polisher 24. The operator then activates system 20 which then proceeds automatically until operator input is required as will be described. Wafer cassette 46 is secured in place by air actuated rotary swing clamps 82. Castellated alignment shelves 94 of alignment tower 48 are moved forward towards integrator 52 until halted at integrator 52. Pusher 54 is then prepared to load wafers 28 by having bars 108 of loading plate 100 move to a position flush with front face 110 of fingers 102 thus masking the castellation of fingers 102.

Pusher 54 is then moved towards integrator 52 such that loading plate 100 enters wafer cassette 46 and pushes wafers 28 onto the shelves of integrator 52. Loading plate 100 moves towards integrator 52 as a result of air cylinder 66 being actuated by control inputs from controller 28 which are sent to loader 22 through cable link 86. Loading plate 100 moves forward until it is identified by another proximity sensor, at which time the forward movement of loading plate 100 is halted which may be by a shot pin actuated to prevent further movement. Load plate 100 of pusher 54 is then retracted from wafer cassette 46 until pusher 54 reaches adjustable shock absorber 112 which prevents pusher 54 from running into stops or anchors 58 (a similar shock absorber may be placed at the opposite end of guide rails 56 for alignment tower 48). Rotary swing clamps 82 then open and the operator may remove the empty wafer cassette 46 in preparation for receiving a filled spacer cassette 80.

The operator may then place filled spacer cassette 80 in cassette staging area 78 and then initiate the spacer loading through controller 28. Spacer cassette 80 may be held against integrator 52 by swing clamps 82. With bars 108 of loading plate 100 still flush with front face 110 and fingers 102, loading plate 100 moves towards integrator 52 and thereby moves spacers 30 between wafers 28 in integrator box 52. At this time the back edges of wafers 28 and spacers 30 may both touch bars 108 (the flats of wafers 28 are initially aligned by bars 108). The proximity sensors again sense that the operation is complete, and the operator then removes the empty spacer cassette 80.

Next, a vibrator 114, which may be located on alignment tower 48, is activated and bars 108 of loading plate 100 are retracted such that the front face of bar 108 is flush with back wall 111 of shelves 104 (thus exposing the merlons and crenels of castellated fingers 102). The vibration facilitates alignment of wafers 28 and spacers 30 between loading plate 100 and alignment shelves 94 of alignment tower 48. The flats of wafers 28 are further aligned during this process by back walls or surfaces 111 of loading plate 100.

Wafers 28 and spacers 30 are then moved in a coordinated fashion between pusher 54 and alignment tower 48 to clamping station 50. A current-pressure (I/P) transducer 116 on air cylinder 60 is used to coordinate the movement of tower 48 with the movement of pusher 54 by reducing the pressure in air cylinder 60 while air cylinder 66, which is acting on pusher 54 operates at a pressure to move pusher 54 towards clamping station 50. Transducer 116 and cylinder or actuator 60 is controlled by control inputs (analog or digital) from controller 28 delivered over cable link 86 (FIG. 1). The current-pressure transducer 116 allows alignment tower 48 to move towards clamping station 50 in a manner coordinated with pusher 54 so that the force experienced by wafers 28 and spacers 30 between alignment portion 92 of tower 48 and loading plate 100 of pusher 54 remains approximately constant as wafers 28 and spacers 30 are moved. A bleed-off cylinder might be used, but might pose a risk that an irregular movement might occur and damage or misalign wafers 28, and therefore, I/P transducer 116 is preferred.

Before pusher 54 may begin to move toward clamping station 50, the shot pin, if one is used, is disengaged to allow the movement. Wafers 28 and spacers 30 move between alignment tower 48 and pusher 54 while vibrator 114 is operating to align wafers 28 and spacers 30 with respect to shelves 94 of tower 48 and fingers 102 of loading plate 100 so that the center of wafers 28 and centers of spacers 30 are substantially aligned. Pusher 54 and alignment tower 48 move towards clamping station 50 until the centers of wafers 28 and spacers 30 are approximately aligned with the centers of clamping plates 32 and 34. At this time, stack clamps 76 are activated clamping wafers 28 and spacers 30 between plates 32 and 34 and creating a stack 36. The stack may then be moved to polisher 24.

Figure 5:
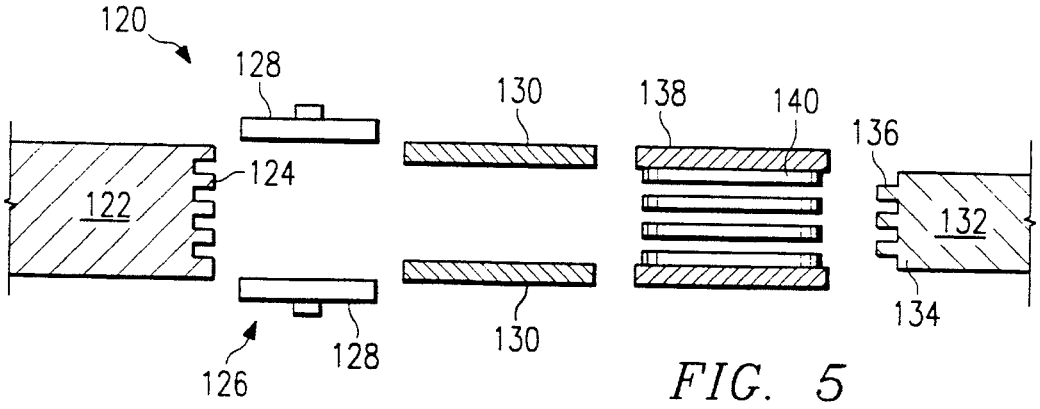
FIG. 5 is a schematic cross sectional view of a simplified loader according to one aspect of the present invention showing the wafer cassette before being loaded.

A simplified demonstration of the basic loading steps are shown in FIGS. 5 through 12 for a simplified loader 120 that is similar to loader 22. FIG. 5 shows a schematic cross section taken along a longitudinal centerline of simplified loader 120 at an initial position ready for the loading process to begin. Simplified loader 120 has alignment tower 122 with alignment shelves 124; a clamping station 126 with clamping plates 128, which may be moved toward each other by an actuator that is not shown; integrator box 130, which has shelves on its inside vertical walls, but are not shown; and a pusher 132 having a loading plate 134 with loading fingers 136. Loading plate 134 for simplified loader 120 is shown without any type of bars analogous to bars 108 of loading plate 100. Shown also in FIG. 5 is wafer cassette 138 which contains wafers 140 already aligned with their flats facing pusher 132. The shelves on the two side vertical walls of wafer cassette 138 are not shown.

Figure 6:
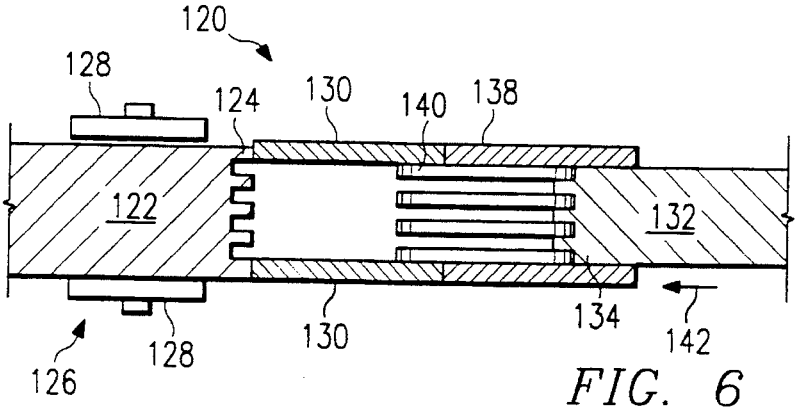
FIG. 6 is a schematic cross sectional view of a simplified loader according to one aspect of the present invention showing the wafers being loaded from the wafer cassette into the integrator.
Figure 7:
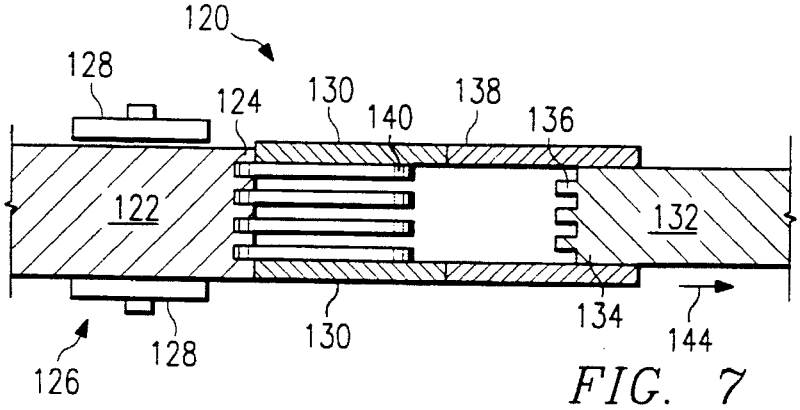
FIG. 7 is a schematic cross sectional view of a simplified loader according to one aspect of the present invention showing the wafers in the integrator and removal of the pusher.

Referring now to FIG. 6, wafer cassette 138 has been positioned to abut an edge of integrator box 130 and simplified loader 120 has been activated. After activation, alignment tower 122 moves through clamping station 126 to abut integrator box 130 opposite cassette 138. Loading plate 134 of pusher 132 is then moved towards integrator box 130 causing wafers 140 to be pushed in the direction of arrow 142. As shown in FIG. 7, the wafers are pushed by loading plate 134 until the wafers enter integrator box 130 and continue into alignment shelves 124 of alignment tower 122. Pusher 132 is then retracted in the direction of arrow 144.

Figure 8:
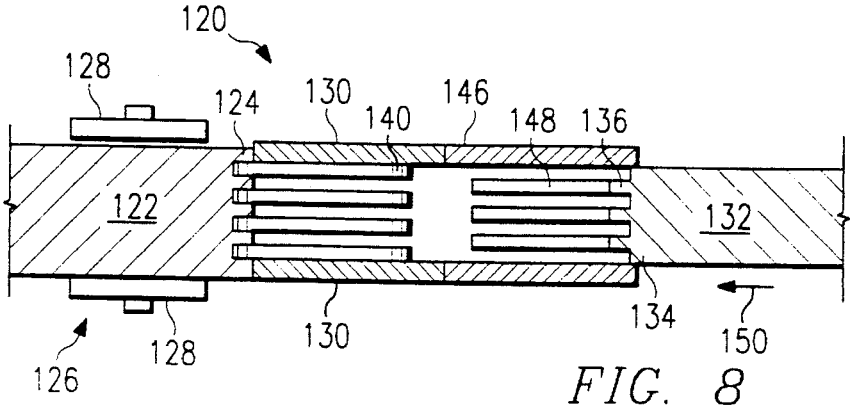
FIG. 8 is a schematic cross sectional view of a simplified loader according to one aspect of the present invention showing the spacer cassette in place and the pusher beginning to push the spacers into the integrator.
Figure 9:
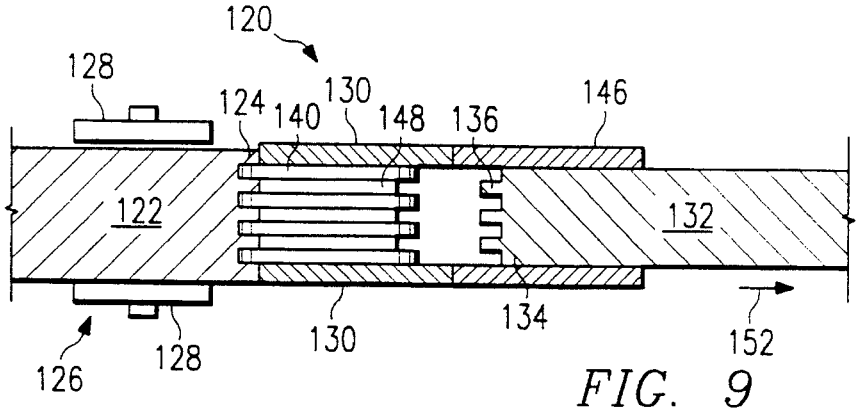
FIG. 9 is a schematic cross sectional view of a simplified loader according to one aspect of the present invention showing the pusher being retracted after the spacers have been placed in the integrator.

Referring to FIG. 8, spacer cassette 146 has been positioned so as to abut a side of integrator box 130. The shelves of spacer cassette 146 that are located on the inner portion of the vertical walls of wafer cassette 146 are not shown. Pusher 132 is then caused to move in the direction of arrow 150 such that loading plate 134 engages spacers 148 and moves them towards integrator box 130. Referring to FIG. 9, spacers 148 are shown integrated between wafers 140, and pusher 132 is being retracted in the direction of arrow 152. After retracting pusher 132, spacer cassette 146 may be removed.

Figure 10:
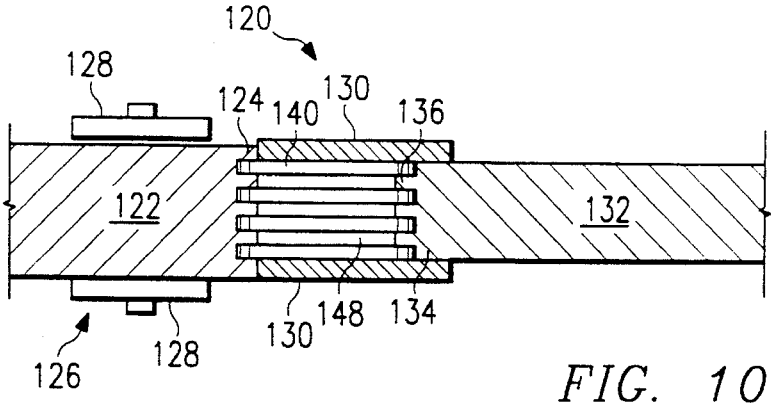
FIG. 10 is a schematic cross sectional view of a simplified loader according to one aspect of the present invention showing the wafers and spacers in the integrator being aligned.

Referring now to FIG. 10, spacer cassette 146 has been removed, and pusher 132 has been moved in the direction towards integrator box 130 such that loading fingers 136 of loading plate 134 now engage an edge of wafers 140 and spacers 148. A vibrator may now be used to cause vibration of wafers 140 and spacers 148 to facilitate alignment of them between loading fingers 136 and alignment shelves 124.

Figure 11:
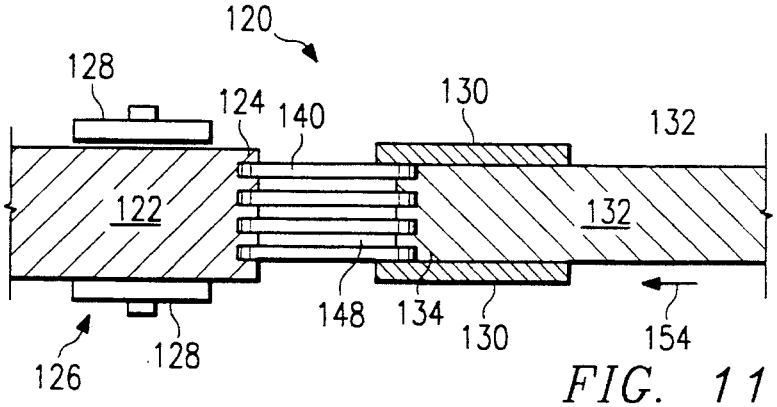
FIG. 11 is a schematic cross sectional view of a simplified loader according to one aspect of the present invention showing the pusher and alignment tower moving the wafer and spacers towards clamps.
Figure 12:
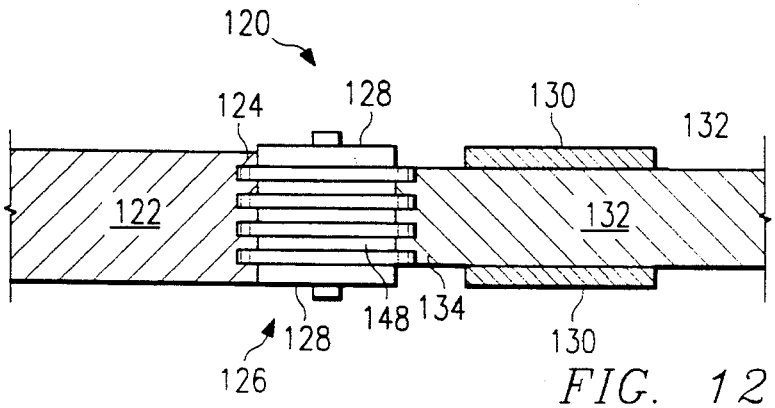
FIG. 12 is a schematic cross sectional view showing a simplified loader according to one aspect of the present invention showing the wafers and spacers being clamped in place to form a stack.

Referring to FIG. 11, aligned wafers 140 and spacers 148 are held between alignment shelves 124 and loading fingers 136 while simultaneously being moved in the direction of arrow 154 towards clamping station 126. Referring to FIG. 12, once wafers 140 and spacers 148 reach alignment station 126, the clamping plates may be clamped to secure wafers 140 and spacers 148 together to form a stack analogous to stack 36 shown in FIG. 13. The proceeding simplified representation of FIGS. 5 through 12, were for a loader handling four wafers 140, but in the embodiment shown in FIGS. 1 through 3, loader 22 may handle many more wafers than just four. The basic process and apparatus of the embodiment of FIGS. 1 through 3 is, however, analogous in many respects to simplified loader 120 of FIGS. 5 through 12.

Figure 14:
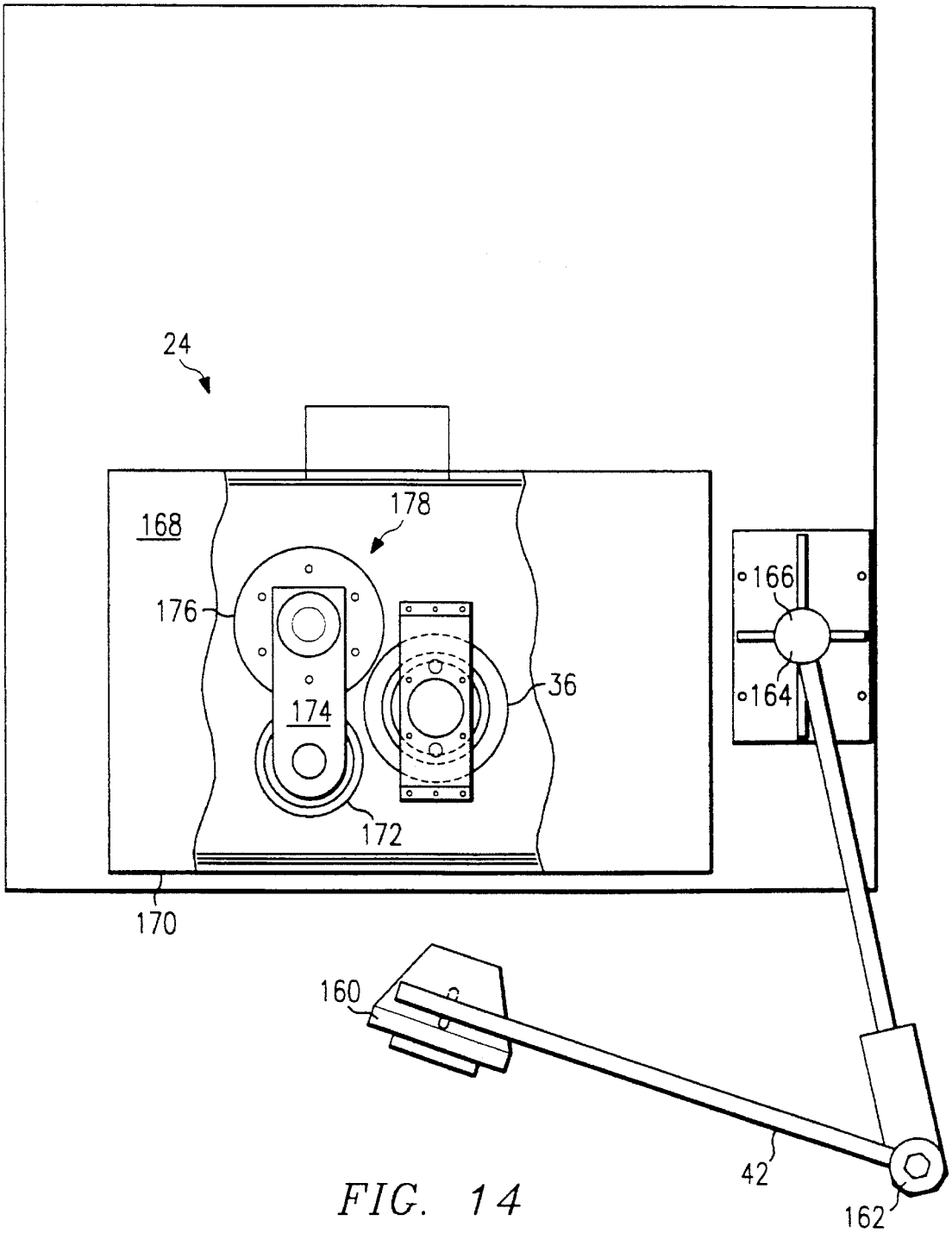
FIG. 14 is a plan view partially broken away of a polisher according to one aspect of the present invention.

Returning again to polishing system 20 of FIG. 1, which includes loader 22 shown in more detail in FIGS. 2 and 3, stack 36 shown in FIG. 13 is produced by the processes conducted by loader 22. After stack 36 is formed, it may be moved to polisher 24. To move stack 36, a transfer unit 40 such as a swing hoist 42 may be used. Swing hoist 42 has a tool balancer 160 from which stack 36 is removably attached. As shown in FIG. 14, swing hoist 42 may have several pivots or joints such as first pivot 162 and second pivot 164. Pivot 164 may be on top of a mounting pole 166.

Polisher 24 may have an enclosed container 168 to prevent the splashing liquids that may be used during the rinsing and chemo-mechanical polishing process and for reasons of environmental control. Container 168 has a first side 170. First side 170 of polish container 168 may have a door for opening and closing wall 170. With the door open in wall 170, hoist 42 may be used to move stack 36 through wall 170 of polisher 24 and into position in polisher 24 as shown in FIG. 14.

Polisher 24 may have a polishing wheel or roller 172 connected by an arm 174 to a servo 176. An identical or similar structure to polishing wheel 176, arm 174 and servo 176 may be placed on the opposite side of stack 36 to either include another polishing wheel or a prepolishing wheel. If a prepolishing wheel is used, a rotating level/abrasive wheel may be brought up against the edges of rotating wafers 28 of stack 36 for smoothing the edges. Servo 176, arm 174 and polishing wheel 172 form a polishing unit 178. Polishing unit 178 may include sensors to enable a position and torque feedback loop to be established with controller 28 to allow for a constant force, or other desired force, to be developed between wheel 172 and stack 36 during polishing, or if a prepolish step is used, for the prepolishing abrasive process. As an alternative to using servo 176 and feedback loops to provide a constant force, a counterbalanced arm with weights attached thereto in proportion to the desired strength of the constant force may be used to move wheel 172 against stack 36.

The edges of wafers 28 and stack 36 may be chemo-mechanically polished, which may be similar to the process used for polishing the surface of wafers, by causing stack 36 to be rotated against rotating wheel 172 covered with polymeric polishing pads. The polymeric polishing pads may either be partially grooved as shown 76 for securing clamping plates 32 and 34. Clamping in U.S. Pat. No. 5,128,281 or stack 36 may be polished by two or more polishing wheels 172, at least one of which may have grooves to polish the tapered edges of wafers 28. Polisher 24 may include a system to provide and measure polish slurry, humidity, temperature, and the force of the polish wheel against wafers 28 using the position and torque feedback loops.

After placing stack 36 in polisher 24, the door on side 170 of container 168 may be closed. The door on side 170 of container 168 may include proximity sensors such as inductive sensors that tell controller 28 that the doors are closed. Mounting shafts 72 and 74 of stack 36 may mate with a multi-tooth gear coupling to cause stack 36 to rotate within polisher 24. After the doors of container 168 have been closed, a fan, heater and humidity spray may be started if desired; discrete sensors may be located within container 168 to provide feedback to controller 28 in order to control these actions. Controller 28 also controls all the motor speeds within polisher 24, e.g., motors 202 and 226, which are discussed below.

Polishing unit 178 may consist essentially of a rotary drive, polishing wheel 172, and a means to force polishing wheel 172 against rotating wafers 28 of stack 36. The rotary drive may be belt driven from a variable speed direct current motor to allow changes in speed and to give high torque at all speeds. Polishing wheel 172 may consist of a hard central core surrounded by a partially-grooved polishing sleeve such as described in U.S. Pat. No. 5,128,281. Alternatively, one wheel may have a plain, cylindrical pad while an additional wheel may be placed on the other side of stack 36 with a fully-grooved polishing pad to match the wafer edges.

Figure 16:
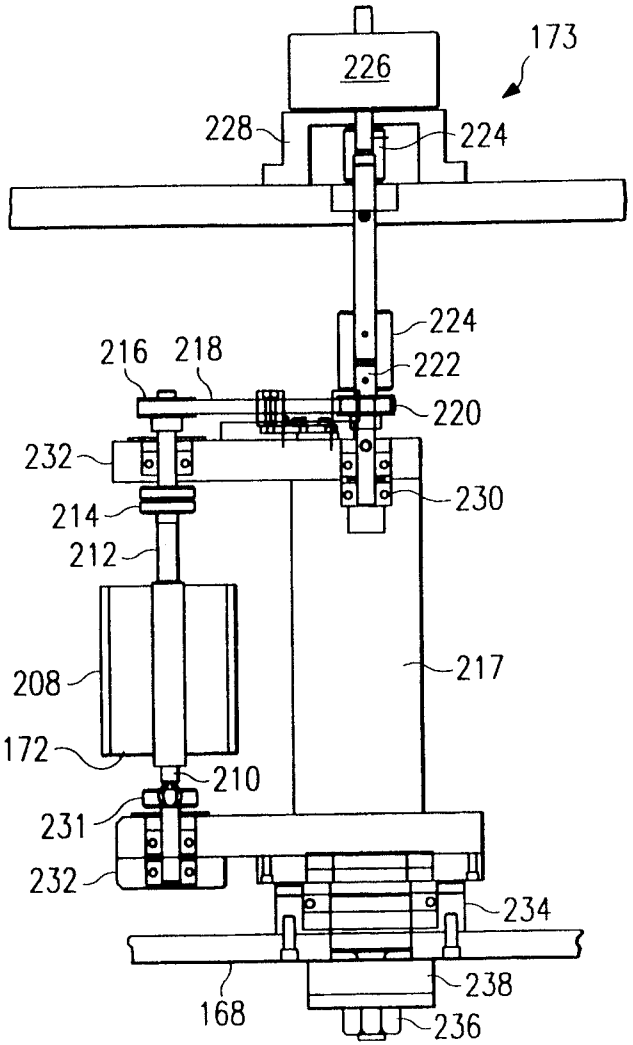
FIG. 16 is a schematic elevational view of a portion of a polisher according to an aspect of the present invention.
Figure 15:
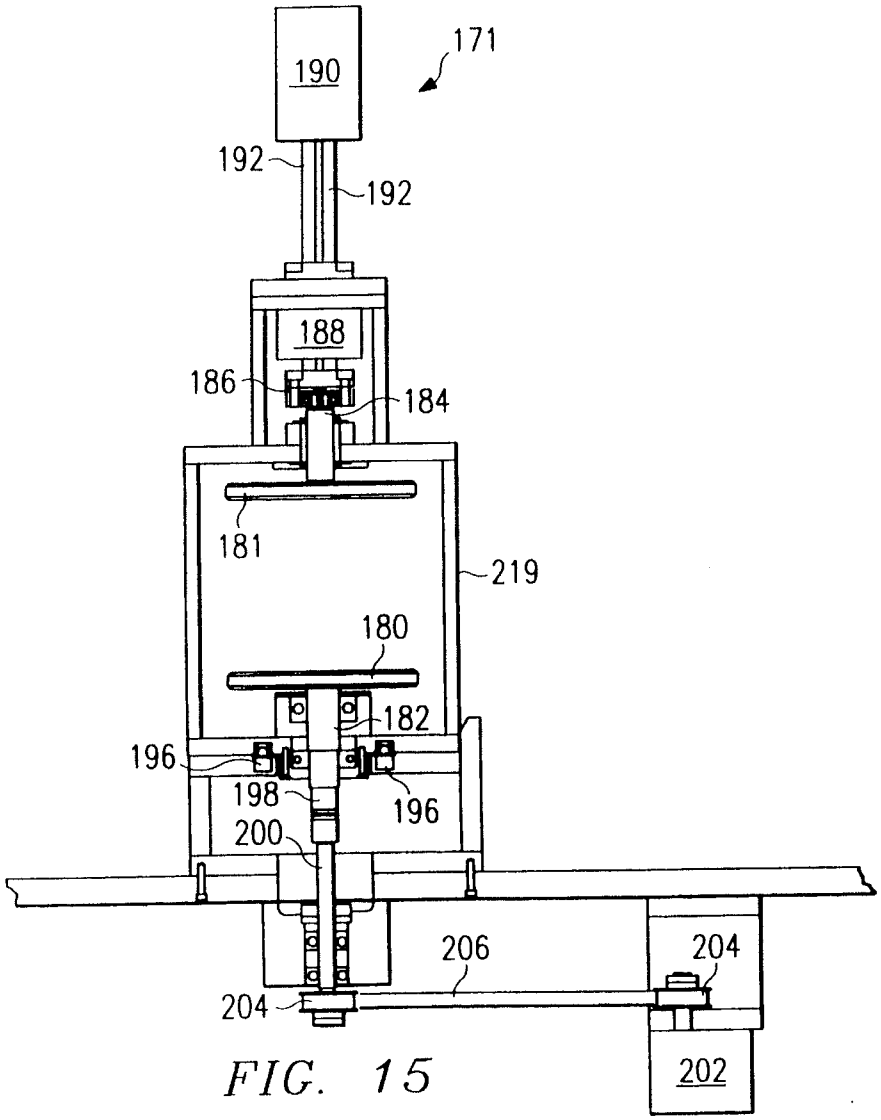
FIG. 15 is a schematic elevational view of a portion of a polisher according to an aspect of the present invention.
Figure 17:
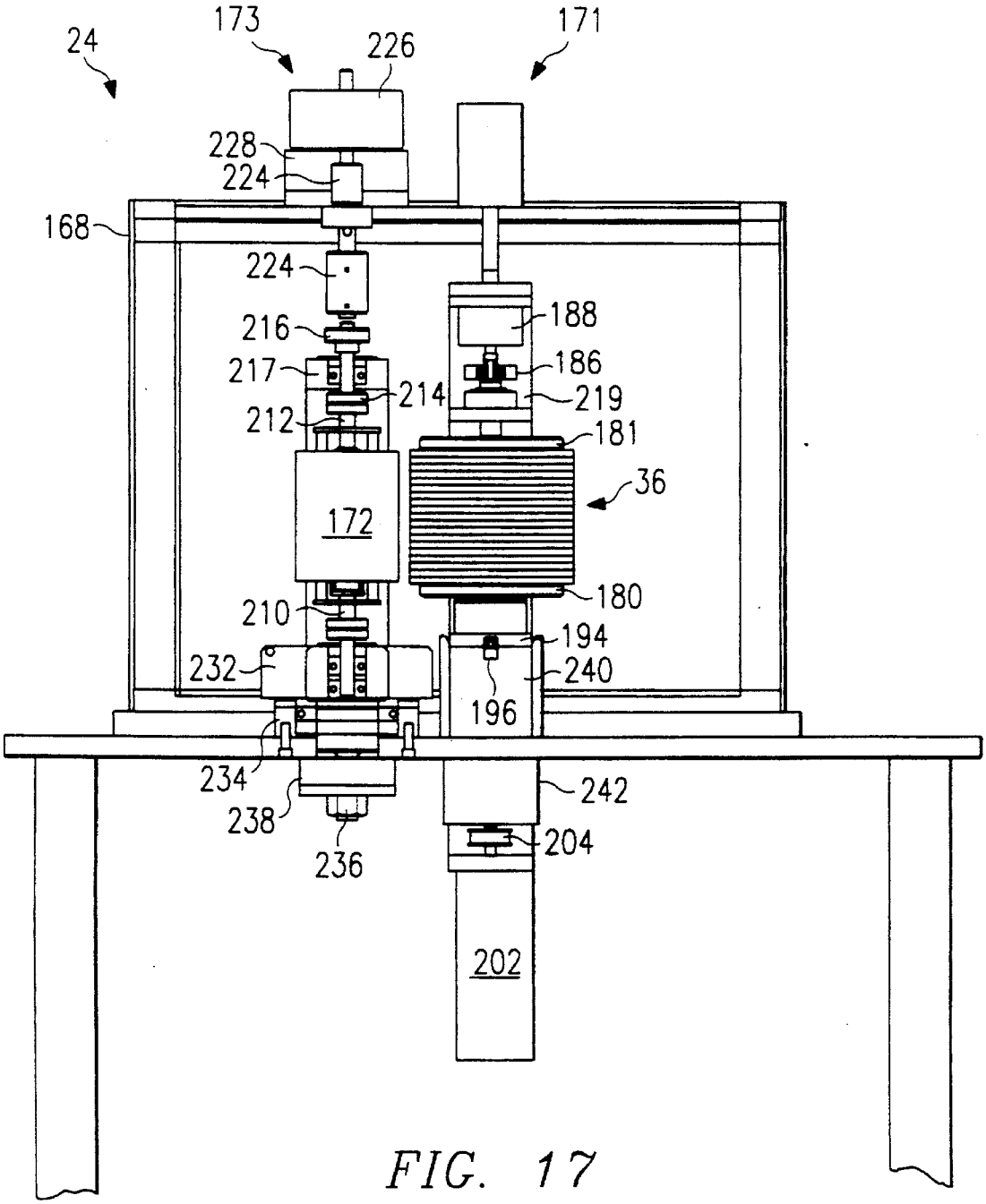
FIG. 17 is an elevational view of a polisher according to one aspect of the present invention showing the stack loaded in the polisher.

Referring now to FIGS. 15–17, an embodiment of polisher 24 is shown. FIG. 17 shows stack polishing assembly 171 and polish wheel assembly 173 with stack 36 inserted in polisher 24 and with polishing wheel 172 in close proximity to stack 36, but not yet making contact. Referring to FIG. 15, stack polishing assembly 171 has a lower platen 180 and an upper platen 181 between which stack 36 is removably mounted for polishing. A first portion of a drive shaft 182 is coupled to lower platen 180. Upper platen 181 is coupled to a platen shaft 184, which interfaces with bearing 186. Upper platen 181 may move towards or away from lower platen 180 according to the influence of stack clamp air cylinder 188. Fixture clamp air cylinder 190 has cylinder rods 192 for activating movement of clamp fixture 194 (FIG. 17).

Locating pins 196 are located beneath lower platen 180. First portion of drive shaft 182 connects platen 180 with drive coupling 198, which is in turn connected to second portion of drive shaft 200. Second portion of drive shaft 200 may be linked with motor 202 by pulleys 204 and timing belt 206.

Referring to FIG. 16, polishing wheel assembly 173 is shown. Assembly 173 may have a polishing wheel 172. Polishing pad 208 covers an outward portion of polishing wheel 172. Polishing wheel 172 has shafts 210 and 212 which allow polishing wheel 172 to rotate. Shaft 212 is connected to a quick disconnect coupling 214, and quick disconnect coupling 214 is linked to pulley 216. Quick release 214 may be located proximate swing arm 232. Pulley 216 is connected by belt 218 to pulley 220, which in turn is linked to shaft 222. Shaft 222 is linked through couplings 224 to motor 226, which is held in place by bracket 228. Bearing 230 is found proximate pulley 220.

Shaft 210, which is linked to polishing wheel 172, is configured to rotate on one end of swing arm 232. Shaft 210 locates by ball-nose hex pattern 231 that allows wheel 172 to be pivoted out and removed like a ball-nosed screwdriver. Swing arm 232 is rotatably linked to bearing housing 234, which is connected to a portion of container 168 by securing means such as nut 236, which has spacer 238.

Referring again to FIG. 17, stack 36 is shown inserted in polisher 24. Polisher wheel 172 with polishing pad 208 is moved onto stack 36 by swing arms 232. Polishing pad 208 is moved onto stack 36 in a manner that will account for the flats on wafers 28. From the view shown in FIG. 17, fixture 194 and fixture base 196 may be seen. Additionally, mount 242 is shown beneath fixture base 240. Connector members 217 and 219 connect the top and bottom portions of assembly 171 and 173 respectively.

Polishing unit 178 may account for the flats of wafers 28 by a counterbalance assembly formed of weights and pulleys. It can, however, also be done by a spring assembly or air piston. Yet another method of applying the polishing force is to use a servo motor 176 as shown in FIG. 14 with a torque mode for the polish wheel drive. This torque acts through arm 174 to apply a constant force against the rotating wafers. Once controller 28 senses that any variables that the operator desires to control within container 168 such as temperature and humidity have reached a set point, air cylinders may be actuated or pressure released or a servo 176 may be actuated to cause polishing wheel 172 to come into contact with stack 36.

Polisher 24 may contain a slurry system. The slurry system may contain a pump, a slurry tank, a flow meter, programmable flow control, a heater, appropriate delivery tubing, sensors and links to controller 28 as may be necessary. The slurry may be heated as it flows from the storage slurry tank so that the entire tank does not necessarily have to be heated. The tubing is arranged so that it delivers slurry at the top of stack 36. The slurry flows down stack 36 to supply polishing material to all wafers 28 of stack 36. After polishing wheel 172 has started, the slurry system begins pumping slurry until the polishing cycle is over, after which a rinse system may divert part of its flow through the slurry nozzles and tubing to clean them. To keep slurry out of the bearings in polisher 24, e.g., bearing housing 234, polisher 234 may be sealed bearings, but nitrogen may also be used to purge the bearings to keep slurry out.

Polisher 24 also may include a rinsing system which brings a spray of water or a neutralizing fluid to bear upon polishing wheel or wheels 172 and on stack 36. Rinsing the slurry off stack 36 will help keep unloader 26 free of slurry, and the rinsing system will help keep slurry from drying on polishing wheel 172 and thus avoiding crystallization of the polished slurry on the polishing pads. Additionally, the rinse will prevent further etching of wafers 28. Additional cycle time may be saved by heating the rinse water to approximately the same temperature as may be desired for the polishing operation. Once the polishing process in polisher 24 is completed, transfer unit 40 may be used to move stack 36 from polisher 24 to unloader 26.

Figure 18:
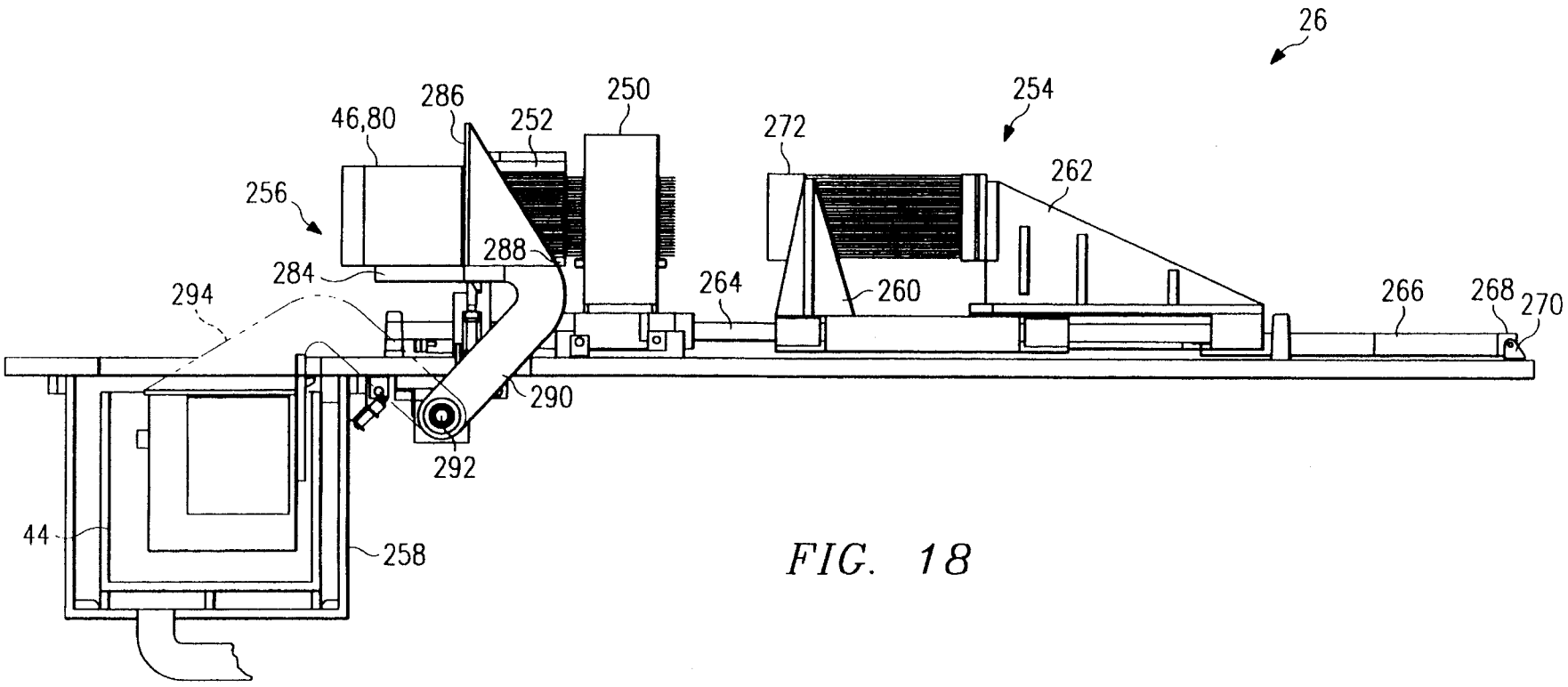
FIG. 18 is an elevational view of an unloader according to one aspect of the present invention.
Figure 19:
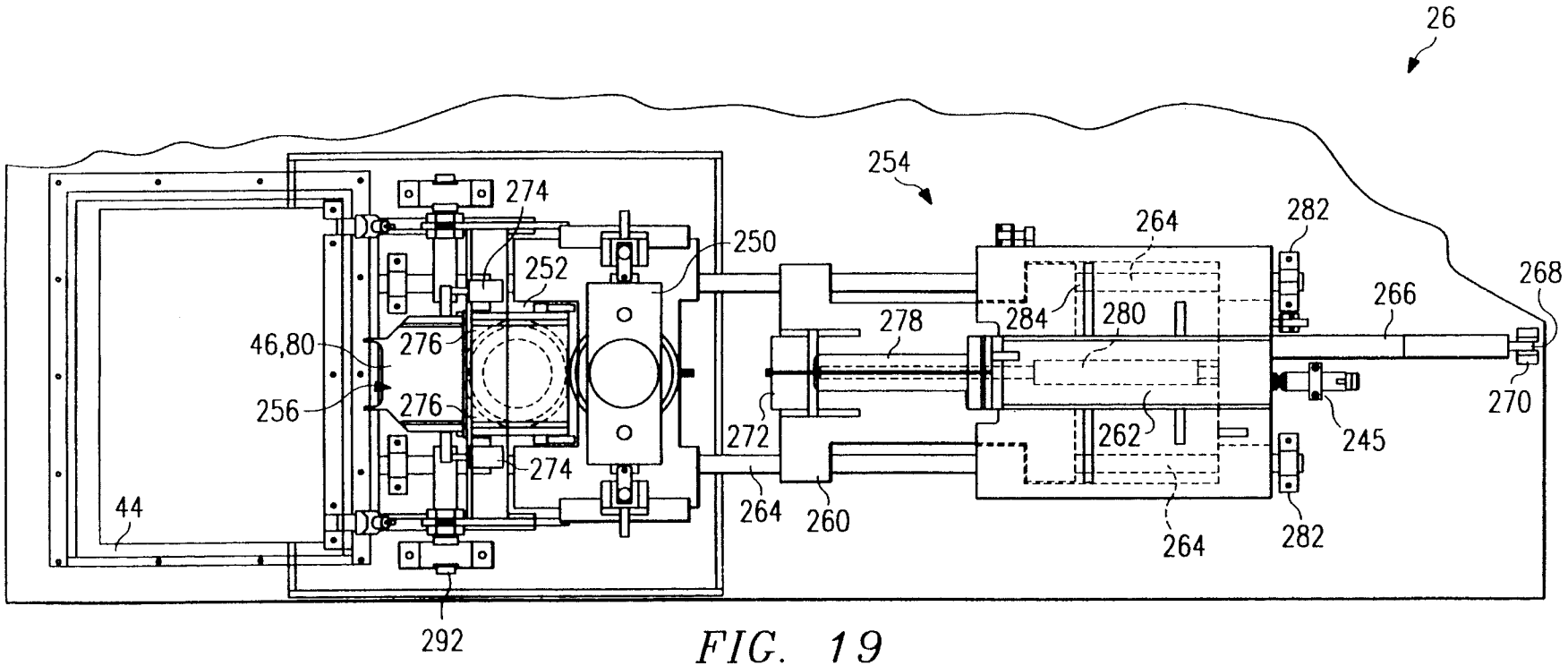
FIG. 19 is a plan view of the unloader of FIG. 18.

Referring now to FIGS. 18 and 19, there is shown an embodiment of unloader 26 of polishing system 20. Unloader 26 in many respects performs the opposite steps of loader 22. Unloader 26 may have a stack staging area 250 for receiving stack 36 from transfer unit 40 after polisher 24. Stack staging area 250 may be indexed to a separator box 252. A pushrod assembly 254, may be used for the purpose of moving wafers 28 out of stack 36 and likewise for moving spacers out of stack 36.

Unloader 26 has a cassette staging area 256 which is indexed to separator box 252. Unloader 26 also has a neutralizing tank 44 containing a liquid in which wafers 28 may be submerged to neutralize the slurry that might remain on them from the polishing process that occurred at polisher 24. In a preferred embodiment, tank 44 contains cascading water in tank 44 that may be caught by a cascading overflow tank from where it may be recirculated or directly drained.

Stack 36 is placed in unloader 26 at stack staging area 250. Stack 36 may then be unclamped by releasing the clamping force between first clamping plate 32 and second clamping plate 34. Pushrod assembly 254 may then be used to remove wafers 28 and spacers 30 from stack 36. Pushrod assembly 254 may be formed by two basic units: first unit 260 and second unit 262. First unit 260 is slidably mounted on guiderails 264. First unit 260 may be moved with respect to guiderails 264 in response to air cylinder 266. First end 268 of air cylinder 266 is anchored relative to the frame of reference of stack staging area 250 and tank 44 by anchor 270. Therefore, when air cylinder 266 is caused to extend, a force is generated between anchor 270 and first unit 260 that urges first unit 260 towards stack staging area 250. When air cylinder 266 is caused to retract, first unit 260 is urged toward anchors 232. Shock absorber 245 may prevent first unit 260 from contacting anchors 282. When stack 36 is at stack staging area 250 and is unclamped and if cylinder 266 is activated, it causes first unit 260 to move towards staging area 250 and causes block face 272 of first unit 260 to engage wafers 28 and spacers 30 and may move them from staging area 250 into separator box 252.

Separator box 252 has shelves on the inside surface of the two vertical walls that suspend wafers 28 with spacers 30 thereon much like integrator 52. The shelves of the separation box 252 are slightly angled or ramped to restore the clearances between wafers and spacers that existed originally within their corresponding cassettes 46 and 80. With wafers 28 and spacers 30 now in separation box 252, spacers 30 can now be unloaded to wafer cassette 80.

To remove spacers 30, the operator places spacer cassette 80 in cassette staging area 256 where swing clamps 274 may be actuated to hold spacer cassette 80 next to a surface of separator box 252. Wafer stops 276 (FIG. 19) may be positioned within separator box 252 by an actuator such that frictional forces between spacers 30 and wafers 28 will not be able to force wafers 30 out of separator box 252 as spacers 30 are removed. Wafer stops 276 may be actuated prior to pushing stack 36 into separator box 252. Spacers 30 may then be removed from separator box 252 by spacer-pushing bars or fingers 278.

Second unit 262 may be a subelement of first unit 260 in that second unit 262 may move with first unit 260 when first unit 260 is caused to move by actuator 266 as previously discussed. Second unit 262 is slidably mounted on guiderails 264 and contains air cylinder 280. The first end of air cylinder 280 is secured to first unit 260, and a second end of air cylinders 280 is secured to second unit 262 such that when air cylinder 280 is caused to extend, second unit 262 will be urged in a direction towards staging area 250 relative to the position or frame of reference of first unit 260. Because block face 272 is a part of first unit 260 and block face 272 contains slots for receiving spacer-pushing bars 278 of second unit 262, when air cylinder 280 is actuated so as to cause the cylinder to expand, the spacer pushing bars 278 move in a direction towards tank 44 relative to block face 272. If cylinder 280 is sufficiently activated, spacer-pushing bars 278 will extend beyond block face 272 and engage spacers 30 in separator box 252. This configuration is used to cause spacer-pushing bars 278 to extend into separator box 252 to push spacers 30 out of box 252 and into attached spacer cassette 80 while maintaining wafers 28 in separator box 252. Swing clamps 274 holding spacer cassette 80 may then be released and the operator may remove spacer cassette 80.

The operator may then place wafer cassette 46 adjacent and against the side of separator box 252 that is closest to tank 44 and cause swing clamps 274 to activate to hold wafer cassette 46 in place. Sensing wafer cassette 46 in place and instructed to proceed, controller 28 may then cause wafer stops 276 to be withdrawn. Cassette staging area 256 may be a cassette platform 284 (FIG. 18), on which cassettes 46 or 80 may reside and may have a portion of cassette 46 or 80 residing against cassette aligning surface 286. Separator box 252 is mounted on separator-box platform 288. Cassette platform 284 and cassette aligning surface 286, and separator box platform 288 are all connected and may be integral to tilt arm 290. Tilt arm 290 may rotate or tilt about pivot point 292 under the influence of an actuator. Tilt arm 290 may rotate between at least two positions: a first position shown in solid lines in FIG. 18 and a second position shown in hidden lines in FIG. 18 and designated with reference numeral 294.

Once wafer cassette 46 has been secured on platform 284 by swing clamps 274, and wafer stops 276 retracted, tilt arm 290 may be rotated to its second position shown by reference number 294 under the influence of an actuator. This movement to second position 294 will cause wafers 28 within separator box 252 to slide in to wafer cassette 46 and to become submerged in the neutralizing liquid contained in tank 44. The operator may then remove wafer cassette 46 for further processing, which may include being spun-dried. When the operator seeks to remove wafer cassette 46, tilt arm 290 may be repositioned as shown in FIG. 18 in solid lines, and the wafer cassette unclamped from separator box 252.

Referring again to FIG. 1, controller 28 may be involved in the loading process of loader 22, the polishing process in polisher 24, and the unloading at unloader 26. Controller 28 receives input signals over cable link 86 from loader 22, over cable link 300 from polisher 24, and over cable link 302 from unloader 26. The input signals to controller 28 come from a plethora of sensors and transducers throughout system 20. The plethora or plurality of sensors throughout system 20 are generally proximity or optical sensors positioned to sense the location of most moving parts. Controller 28 may also develop control signals that are delivered to actuators in loader 22 through cable link 86, to actuators in polisher 24 through cable link 300, and to actuators in unloader 26 through cable link 302.

Controller 28 may be a suitable programmable logic controller. In a preferred embodiment, a programmable logic controller designated Modicum AEG by Gould of North Andover, Mass. is utilized. A suitable software for use with controller 28 is commercially available from Computer Technologies Corporation of Milford, Ohio, under the package name "Interact." Controller 28 may have a video interface 304 and a key keyboard or keypad 306. Controller 28 may receive both digital and analog inputs from the sensors. Controller 28 may include a self-diagnostic program to check for component errors and to move components to a fail-safe position if controller 28 senses any error. Sensors are utilized throughout system 20 at every possible step so that positive knowledge can be obtained by controller 28 as to each function in the process.

Figure 20:
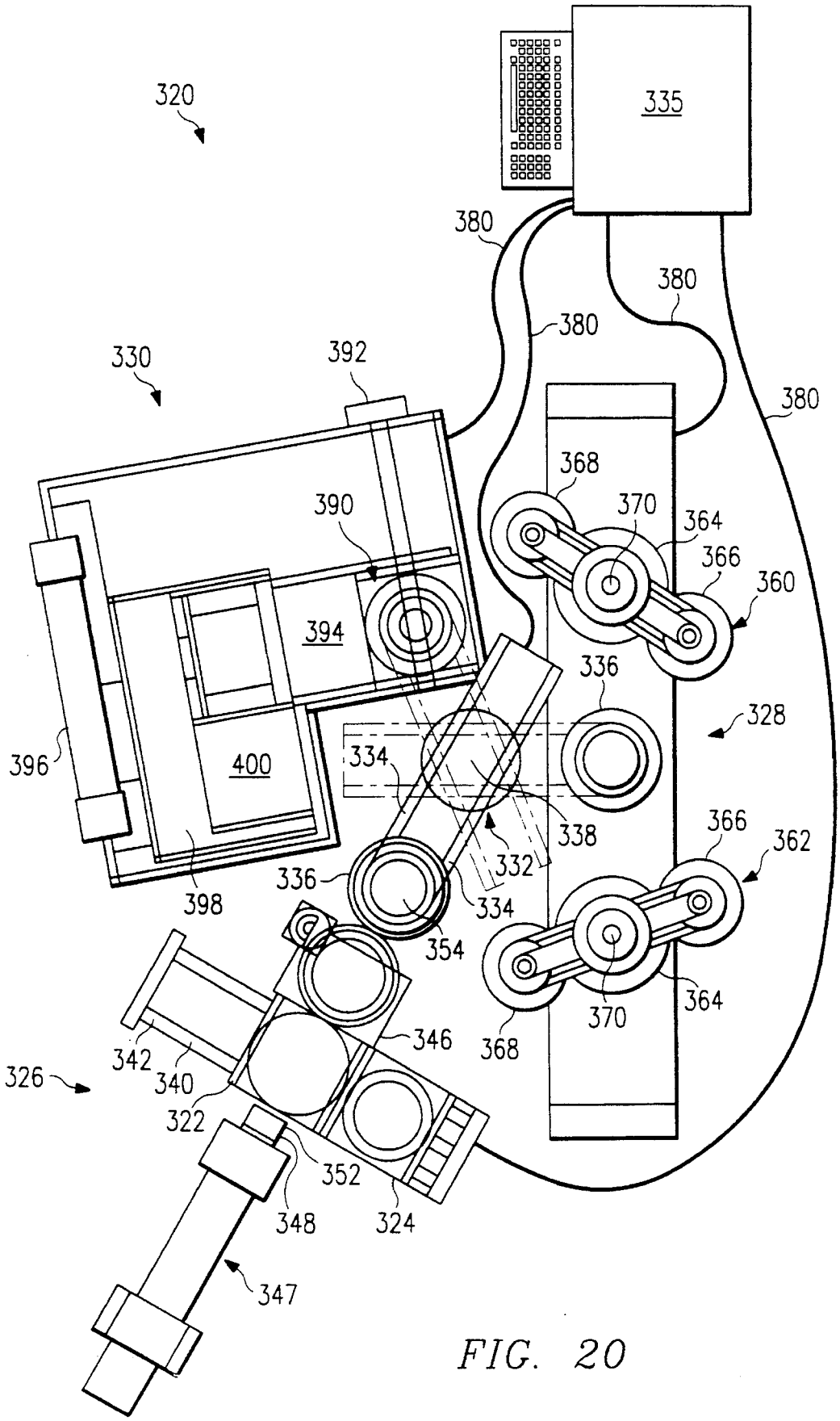
FIG. 20 is a schematic plan view of an alternative embodiment of a polishing system according to another aspect of the present invention.

Referring now to FIG. 20 there is shown an alternative embodiment according to an aspect of the present invention. Polishing system 320 is completely automated once wafer cassette 322 and spacer cassette 324 are loaded. System 320 has five basic components or subsystems: a loader 326, a polisher 328, an unloader 330, a transfer unit 332, and a controller 335.

Transfer unit 332 consists of a pivot arm 334 upon which a stack 336 containing wafers and spacers as previously described may be moved relative to pivot point 338 of transfer unit 332. Transfer unit 332 is configured to selectively cause stack 336 to rotate relative to arms 334; the dashed lines of FIG. 20 show several of the positions to which pivot arm 334 may rotate.

Loader 326 is configured in many respects analogously to loader 22 of FIGS. 1 through 3. Loader 326 has, however, a load shuttle 340 for automatically positioning wafer cassette 322 and spacer cassette 324. Load shuttle 340 has rails or tracks 342 along which cassettes 322 and 324 are slidably mounted. An actuator (not shown) may be used to slide wafer cassette 322 on track 342 such that wafers 344 within cassette 322 are aligned with integrator box 346. Pusher 347 may then be caused to move towards integrator 346 so that loading block or plate 348 of pusher 347 causes wafers 344 to be removed from cassette 322 and into integrator 346 in a manner analogous to that previously discussed for the first embodiment. The actuator of load shuttle 340 then causes wafer cassette 322 to move away from integrator 346 and spacer cassette 324 to be moved into position adjacent to integrator 346. Pusher 347 is then again activated causing spacers 350 to be pushed on top of wafers 344 within integrator 346. The actuator of load shuttle 340 may then cause spacer cassette 324 to be removed, and then pusher 347 may be moved up into position so that loading fingers 352 of loading block 348 may be moved against wafers 344 and spacers 350.

A vibrator may then be turned on and pusher 347 may cause wafers 344 and spacers 350 to move to clamping area 354 of transfer unit 332. Transfer unit 332 may contain an alignment tower against which wafers 344 and spacers 350 are pressed, and the alignment tower of transfer unit 332 then moves in a coordinated fashion in a manner identical to the movements of alignment tower 48 and pusher 54 in the embodiment of FIGS. 1 through 3 until the centers of wafers 344 and spacers 350 are aligned with clamping station 354 at which time they are clamped. Pusher 347 may then be retracted. Transfer unit 332 then may rotate about pivot point 338 to place stack 336 within polisher 328.

Polisher 328 functions analogously to polisher 24 of the first embodiment. Polisher 328 may, however, have a first polishing unit 360 and a second polishing unit 362. Each polishing 360 and 362 is formed by servos 364, a prepolishing wheel 366, and a polishing wheel 368. Servo 364 rotates about pivot point 370. Thus, after the initial setup, servo 364 may cause prepolish wheels 366 to come into contact with stack 336. After prepolishing process, servo 364 may be activated in a manner that causes the servo to rotate polishing wheels 368 into contact with stack 336. The two prepolishing wheels 366 and two polishing wheels 368 enhance the speed of the polishing process. After polishing, stack 336 may be rotated about pivot point 338 into unloader 330.

Unloader 330 operates in many respects analogously to unloader 26 of the first embodiment. Transfer unit 332 moves stack 336 from polisher 328 to unloader 330. Stack 336 is caused to interface with separator 390. The wafers and spacers of stack 336 are moved into separator 390, which increases the separation therebetween. Separator 390 contains wafer stops analogous to those of the first embodiment. After the wafers and spacers are inserted into separator 390, the unit may rotate by rotary axis 392 such that separator 390 rotates beyond area 394 and into neutralizing tank 398. Once in tank 398, the spacers will be removed from separator 390 under the influence of gravity, and will be inserted or caught by a spacer cassette which is held at cassette staging area 400. Cassette staging area 400 is controllable, and may be positioned or indexed relative to the separator 390 once it is in tank 398 by a rodless cylinder 396. Once the spacers are removed into a spacer cassette and aligns a wafer cassette. Once the wafer cassette is in position, the wafer stops are removed and the wafers fall into the wafers cassette. The operation is then complete, and the operator may then remove the cassettes.

In an alternative embodiment for automatic unloader 330, an unloader based on the embodiment of unloader 26 of FIGS. 18 and 19 may be used. In the alternative embodiment, transfer unit 332 would rotate stack 336 into the position shown by stack staging area 250 in FIG. 18. An additional change would be that a cassette transfer unit would automatically position the wafer cassette at cassette staging area 256. Pushrod assembly 254 may then be used in the manner described in connection with FIGS. 18 and 19 to remove wafers from stack 336. Afterwards, the cassette transfer unit would cause the spacer cassette to be removed and the wafer cassette inserted onto staging area 256. The transfer unit for this alternative embodiment of an automatic unloader would be the same or similar as load shuttle 340 of FIG. 20. Once the wafer cassette is in place, the wafer stops 276 would be removed and tilt arm 290 would rotate into tank 44 as previously described. The process would then be complete and the operator could remove the wafer cassette from tank 44.

The completely automatic polishing system 320 is controlled by controller 334. Controller 334 receives information from proximity sensors and transducers throughout system 320 which are received over cables 380 and sends control signals are sent to solenoids and actuators throughout system 320 to control the various moving components.

Although the present invention and its advantages have been described in detail, it should be understood that various changes, substitutions and alterations can be made therein without departing from the spirit and scope of the invention as defined by the appended claims.

What is claimed is:

1. A system for edge polishing a plurality of semiconductor wafers, the system comprising:

a loader including an integrator for loading the plurality of wafers and a plurality of spacers into said integrator to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers.

2. The system of claim 1 further comprising:

a controller for controlling the loader, polisher, and unloader.

3. The system of claim 1 further comprising:

a controller for controlling the loader, polisher, and unloader; and a transfer unit for moving the stack between the loader, polisher, and unloader.

4. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein the loader comprises:

an integrator box for receiving the plurality of wafers and the plurality of spacers;

a clamping station disposed adjacent to the integrator box for receiving and clamping the plurality of wafers and the plurality of spacers to form the stack;

an alignment tower adjacent the clamping station and moveable to be adjacent the integrator box for aligning the plurality of wafers and plurality of spacers prior to clamping by the clamping station; and a pusher for pushing the plurality of wafers and the plurality of spacers into the integrator box and for pushing the plurality of wafers and the plurality of spacers to the clamping station for clamping.

5. The system of claim 1, wherein the polisher comprises:

a stack polishing assembly for receiving and rotating the stack; and a polishing wheel assembly for bringing a polishing surface into contact with the stack while the stack is being rotated by the stack polishing assembly to polish the edges of the plurality of wafers in the stack.

6. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein the unloader comprises:

a stack staging area for receiving and holding the stack while the plurality of wafers and plurality of spacers are removed from the stack;

a separator box adjacent to the stack staging area for separating the plurality of wafers and the plurality of spacers;

a cassette staging area adjacent to the separator box, the cassette staging area for receiving the plurality of wafers and the plurality of spacers; and a pushrod assembly disposed adjacent to the stack staging area and moveable to a position within the separator box, the pushrod assembly for moving the plurality of wafers and the plurality of spacers from the stack staging area into the separator box and selectively into the cassette staging area.

7. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, the system further comprising: a transfer unit for moving the stack between the loader, polisher, and unloader.

8. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein the loader comprises:

an integrator box for receiving the plurality of wafers and the plurality of spacers;

a clamping station disposed adjacent to the integrator box for receiving and clamping the plurality of wafers and the plurality of spacers to form a stack;

an alignment tower adjacent to the clamping station and moveable to be adjacent to the integrator box for aligning the plurality of wafers and the plurality of spacers prior to clamping by the clamping station;

a pusher adjacent to the integrator box opposite the clamping station for pushing the plurality of wafers and the plurality of spacers into the integrator box and to the clamping station for clamping; and a transducer coupled to the alignment tower for facilitating coordinated movement of the alignment tower and pusher with the plurality of wafers and the plurality of spacers therebetween to the clamping station.

9. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment:

a polisher for polishing the edges of each of the plurality of wafers in the stack; and an unloader for unloading the plurality of spacers and for unloading the wafers, wherein the loader comprises:

a cassette staging area for receiving a wafer cassette containing the wafers and a spacer cassette containing the spacers;

an integrator box having a plurality of shelves therein;

a pusher slidably mounted on a guide rail;

an alignment tower slidably mounted on the guide rail, the integrator box disposed between the alignment tower and the pusher;

the pusher operable to move the wafers from the wafer cassette onto the shelves of the integrator box and the spacers from the spacer cassette onto the wafers after the wafers have been moved into the integrator box; and, a clamping station adjacent the integrator box for temporarily clamping the wafers and spacers together once aligned in the integrator box to form the stack.

10. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein the polisher comprises:

a stack polishing assembly comprising:

a first platen, a second platen, an actuator for moving the first platen toward the second platen to hold the stack therebetween, a motor coupled to the first platen for rotating the first with respect to the second platen; and a polishing wheel assembly comprising:

a polishing wheel having a polishing pad, a first swing arm;

a second swing arm, the polishing wheel removably secured between the first swing arm and second swing and, a motor linked to the polishing wheel for rotating the polishing wheel, and an actuator for moving the first and second swing arms to bring the polishing wheel into contact with the stack held between the first and second platen of the stack polishing assembly.

11. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein the unloader comprises:

a stack staging area for receiving and attaching the stack to the unloader;

a separator box adjacent the stack staging area for receiving the plurality of wafers and the plurality of spacers from the stack;

a pushrod assembly for moving the plurality of wafers and the plurality of spacers into the separator box from the stack staging area and for moving the plurality of spacers out of the separator box; and a tilt arm having a pivot allowing the tilt arm to rotate, the tilt arm holding the separator box and operable to rotate the separator box to remove the wafers from the separator box.

12. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein the unloader comprises:

a stack staging area for receiving and attaching the stack to the unloader;

a separator box adjacent to the stack staging area for receiving the plurality of wafers and the plurality of spacers from the stack;

a pushrod assembly for moving the plurality of wafers and the plurality of spacers into the separator box and for moving the plurality of spacers out of the separator box;

a tilt and having a pivot allowing the tilt and to rotate, the tilt arm holding the separator box and operable to rotate the separator box to remove the plurality of wafers from the separator box; and a neutralizing tank adjacent to the tilt arm for receiving the plurality of wafers from the tilt arm.

13. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, the system further comprising:

a controller for controlling the loader, polisher and unloader, and wherein the loader comprises:

a cassette staging area for receiving a wafer cassette containing the plurality of wafers and a spacer cassette containing the plurality of spacers;

a pusher comprising:

guide rails anchored at each end, a pusher base slidably attached to the guide rails, a loading plate attached to the pusher base, and a pusher actuator coupled to the pusher base for moving the pusher on the guide rails relative to the anchored ends in response to control signals from the controller;

an integrator box having interior walls and having a plurality of shelves disposed on the interior vertical walls of the integrator box for receiving and supporting the plurality of wafers, the integrator box adjacent to the pusher and sized to allow the loading plate of the pusher to move within the integrator box;

an alignment tower comprising:

an alignment tower base slidably attached to the guide rails, an actuator coupled to the alignment tower base and operable to move the alignment tower relative to the guide rails in response to control signals from the controller, and a alignment portion connected to the alignment base, the alignment portion for aligning the plurality of wafers and the plurality of spacers; and a clamping station for receiving and clamping the plurality of wafers and the plurality of spacers from the integrator box to form the stack.

14. A system for edge polishing a plurality of semiconductor wafers, the system comprising:

a loader for loading the plurality of wafers and a plurality of spacers to form a stack;

a polisher for polishing the edges of each of the plurality of wafers in the stack; and an unloader for unloading the plurality of spacers and for unloading the wafers, the system further comprising a controller for controlling the loader, polisher and unloader, wherein the loader comprises:

a cassette staging area for receiving a wafer cassette containing the plurality of wafers and a spacer cassette containing the plurality of spacers;

a pusher comprising:

guide rails anchored at each end, a pusher base slidably attached to the pusher guide rails, a loading plate attached to the pusher base, and a pusher actuator coupled to the pusher base for moving the pusher on the guide rails relative to the anchored ends in response to control signals from the controller;

an integrator box having interior walls and having a plurality of shelves disposed on the interior walls of the integrator box for receiving and supporting the plurality of wafers, the integrator box adjacent to the pusher and sized to allow the loading plate of the pusher to move within the integrator box;

an alignment tower comprising:

an alignment tower base slidably attached to the guide rails, an actuator coupled to the alignment tower base and operable to move the alignment tower relative to the guide rails in response to control signals from the controller, an alignment portion connected to alignment base, the alignment portion for aligning the plurality of wafers and the plurality of spacers, and a vibrator for vibrating the plurality of wafers and the plurality of spacers to facilitate alignment; and a clamping station for receiving and clamping the plurality of wafers and the plurality of spacers from the integrator box to form the stack.

15. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, the system further comprising a controller for controlling the loader, polisher and unloader, wherein the polisher comprises:

a first platen;

a second platen;

a first connector member holding the first and second platen and attached to the polisher;

a first actuator for urging the first platen toward the second platen for temporarily holding the stack between the first platen and second platen;

a motor coupled to the first and second platen for rotating the stack between the first and second platen when the stack is inserted therebetween;

a polishing wheel having a polishing pad;

a servo;

a swing arm coupled to the polishing wheel and servo, the servo operable to move the swing arm to bring the polishing wheel into contact with the stack held between the first and second platens in response to control signals from the controller; and a connecting member coupled to the swing and, the connecting member attached to the polisher.

16. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, further comprising a controller for controlling the loader, polisher and unloader, wherein the unloader comprises:

a stack staging area for receiving and holding the stack;

a separator box disposed adjacent to the stack staging area, the separator box for receiving the plurality of wafers and the plurality of spacers;

a pushrod assembly comprising:

a pushrod assembly guide rail anchored at a first end, a first unit slidably attached to the guide rail, a first actuator having a first and second end, the first end of the first actuator coupled to the first unit and the second end of the first actuator anchored relative to the stack staging area so that when the first actuator is caused to expand or retract the first unit will move relative to the second end along the guide rail, the first actuator coupled to the controller and responsive to control signals from the controller, a block face coupled to the first unit for engaging the plurality of wafers and the plurality of spacers to move them from the stack staging area into the separator box when the first unit is caused to move into the stack staging area, the block face formed to have a plurality of slots therethrough, a second unit slidably attached to the guide rail and coupled to the first unit so that when the first actuator is activated by the controller the second unit will move therewith, a second actuator having a first and a second end, the first end of the second actuator coupled to the second unit and the second end of the second actuator coupled to the first unit such that when second actuator is caused to expand or retract the second unit will move relative to the first unit along the guide rails, and a plurality of spacer pushing bars coupled to the second unit and aligned with the slots of the block face such that when the second actuator expands the pushing bars enter the slots through the block face and with continued movement of the second actuator extends through the block face to allow the spacers to be moved out of the separator box while the wafers are temporarily maintained in the separator box;

a cassette staging area for receiving and holding a spacer cassette to receive the plurality of spacers when removed from the separator box by the spacer pusher bars and for receiving a wafer cassette;

a tilt and connected to a pivot for holding the cassette staging area and separator box, the tilt arm moveable between a first position and a second position for urging the plurality of wafers from the separator box into the wafer cassette; and a neutralizing tank for receiving the plurality of wafers when the tilt arm pivots to the second position.

17. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein:

the loader comprises:

an integrator box for receiving the plurality of wafers and the plurality of spacers, a clamping station disposed adjacent to the integrator bsox for receiving and clamping the plurality of wafers and the plurality of spacers to form a stack, an alignment tower adjacent to the clamping station and moveable to be adjacent to the integrator box for aligning the plurality of wafers and the plurality of spacers prior to clamping by the clamping station, and a pusher adjacent to the integrator box opposite the clamping station for pushing the plurality of wafers and the plurality of spacers into the integrator box and then to the clamping station for clamping;

the polisher comprises:

a stack polishing assembly for receiving and rotating the stack, and a polishing wheel assembly for bringing a polishing surface into contact with the stack while the stack is being rotated by the stack polishing assembly to polish the edges of the plurality of wafers in the stack; and the unloader comprises:

a stack staging area for receiving and holding the stack while the plurality of wafers and plurality of spacers are removed from the stack, a separator box adjacent to the stack staging area for separating the plurality of wafers and the plurality of spacers, a cassette staging area adjacent to the separator box, the cassette staging area for receiving the plurality of wafers and the plurality of spacers, a pushrod assembly disposed adjacent the stack staging area and moveable to a position within the separator box, the pushrod assembly for moving the plurality of wafers and the plurality of spacers from the stack staging area into the separator box and selectively into the cassette staging area, and a tilt and for holding the cassette staging area, the tilt and operable to rotate to cause the plurality of wafers to enter the wafer cassette.

18. A system for edge polishing a plurality of semiconductor wafers, the system comprising:

a loader for loading the plurality of wafers and a plurality of spacers to form a stack;

a vibrator for vibrating the plurality of wafers and the plurality of spacers to facilitate alignment;

a polisher for polishing the edges of each of the plurality of wafers in the stack; and an unloader for unloading the plurality of spacers and for unloading the wafers, wherein the loader comprises:

an integrator box for receiving the plurality of wafers and the plurality of spacers, a clamping station disposed adjacent to the integrator box for receiving and clamping the plurality of wafers and the plurality of spacers to form a stack, an alignment tower adjacent to the clamping station and moveable to be adjacent to the integrator box for aligning the plurality of wafers and the plurality of spacers prior to clamping by the clamping station, and a pusher adjacent to the integrator box opposite the clamping station for pushing the plurality of wafers and the plurality of spacers into the integrator box and then to the clamping station for clamping;

the polisher comprises:

a stack polishing assembly for receiving and rotating the stack, and a polishing wheel assembly for bringing a polishing surface into contact with the stack while the stack is being rotated by the stack polishing assembly to polish the edges of the plurality of wafers in the stack;

the unloader comprises:

a stack staging area for receiving and holding the stack while the plurality of wafers and the plurality of spacers are removed from the stack, a separator box adjacent to the stack staging area for separating the plurality of wafers and the plurality of spacers, a cassette staging area adjacent to the separator box, the cassette staging area for receiving the plurality of wafers and the plurality of spacers, a pushrod assembly disposed adjacent the stack staging area and moveable to a position within the separator box, the pushrod assembly for moving the plurality of wafers and plurality of spacers from the stack staging area into the separator box and selectively into the cassette staging area, and a tilt arm coupled to the cassette staging area, the tilt arm operable to rotate to cause the wafers to enter the wafer cassette; and further comprising:

a transfer unit for moving the stack between the loader, polisher, and unloader, and a controller for controlling the loader, polisher, and unloader.

19. A method for edge polishing a plurality of semiconductor wafers comprising the steps of:

placing the plurality of wafers in a loader and activating the loader to cause the loader to move the wafers into an integrator box;

placing a plurality of spacers in the loader and activating the loader to cause the loader to move the spacers onto the plurality of wafers in the integrator box and then aligning the plurality of wafers and the plurality of spacers and clamping the wafers and spacers to form a stack;

vibrating the plurality of wafers and the plurality of spacers;

moving the stack from the loader to a polisher;

removably attaching the stack in the polisher and activating the loader to cause it to automatically polish the edges of the plurality of wafers in the stack; and moving the stack from the polisher to an unloader and activating the unloader to cause the plurality of wafers and plurality of spacers to be separated from the stack.

* * * * *